US009161423B2

(12) United States Patent
Haacke et al.

(10) Patent No.: US 9,161,423 B2
(45) Date of Patent: Oct. 13, 2015

(54) METHOD OF DRIVING A GAS-DISCHARGE LAMP

(75) Inventors: Michael Haacke, Aachen (DE); Lars Dabringhausen, Baesweiler (DE); Xaver Riederer, Aachen (DE); Heinz Helmut Huedepohl, Aachen (DE)

(73) Assignee: Koninklijke Philips N.V., Eindhoven (NL)

( * ) Notice: Subject to any disclaimer, the term of this patent is extended or adjusted under 35 U.S.C. 154(b) by 241 days.

(21) Appl. No.: 14/003,172

(22) PCT Filed: Mar. 5, 2012

(86) PCT No.: PCT/IB2012/051020

§ 371 (c)(1),
(2), (4) Date: Sep. 4, 2013

(87) PCT Pub. No.: WO2012/120435

PCT Pub. Date: Sep. 13, 2012

(65) Prior Publication Data

US 2013/0342107 A1 Dec. 26, 2013

(30) Foreign Application Priority Data

Mar. 10, 2011 (EP) ..... 11157595

(51) Int. Cl.

| | |
|---|---|
| ***H01J 7/24*** | (2006.01) |
| ***H01J 19/36*** | (2006.01) |
| ***H05B 41/36*** | (2006.01) |
| ***H05B 41/292*** | (2006.01) |
| ***H05B 41/38*** | (2006.01) |

(52) U.S. Cl.

CPC ..... *H05B 41/36* (2013.01); *H05B 41/2926* (2013.01); *H05B 41/38* (2013.01)

(58) Field of Classification Search

USPC ..... 315/112–118

See application file for complete search history.

(56) References Cited

U.S. PATENT DOCUMENTS

| | | | | |
|---|---|---|---|---|
| 5,483,127 | A * | 1/1996 | Widmayer et al. | 315/307 |
| 6,072,283 | A | 6/2000 | Hedrei | |
| 6,107,754 | A | 8/2000 | Kim | |

(Continued)

FOREIGN PATENT DOCUMENTS

| | | | |
|---|---|---|---|
| DE | 202006008336 | U1 | 10/2007 |

(Continued)

*Primary Examiner* — Brandon S Cole

(57) ABSTRACT

The invention describes a method of driving a gas-discharge lamp (1) according to conditions in a specific region (R) of the lamp (1), which gas-discharge lamp (1) comprises a burner (2) in which a first electrode (4) and a second electrode (5) are arranged on either side of a discharge gap, which lamp (1) is realised such that the position (PCs) of a coldest spot during an AC mode of operation is in the vicinity of the first electrode (4), which method comprises the steps of initially driving the lamp (1) in the AC mode of operation; monitoring an environment variable of the lamp (1), which environment variable is indicative of conditions in a specific region (R) of the lamp (1); switching to a temporary DC mode of operation at a DC power value on the basis of the monitored environment variable, whereby the first electrode (4) is allocated as the anode; and driving the lamp (1) in the DC mode of operation until the monitored environment variable has returned to an intermediate environment variable threshold value ($T_{DCAC}$). The invention also describes a gas-discharge lamp and a driver for a gas-discharge lamp.

15 Claims, 4 Drawing Sheets

(56) References Cited

U.S. PATENT DOCUMENTS

| | | | | |
|---|---|---|---|---|
| 2008/0252218 | A1* | 10/2008 | Waumans | 315/86 |
| 2010/0060183 | A1* | 3/2010 | Tamai | 315/246 |
| 2010/0128232 | A1 | 5/2010 | Kagata | |
| 2010/0270934 | A1 | 10/2010 | Breuer | |
| 2011/0018460 | A1 | 1/2011 | Samejima | |
| 2013/0214681 | A1* | 8/2013 | Neeser et al. | 315/82 |

FOREIGN PATENT DOCUMENTS

| | | | |
|---|---|---|---|
| EP | 1459608 | B1 | 10/2006 |
| EP | 1768469 | A2 | 3/2007 |
| EP | 2244537 | A2 | 10/2010 |
| WO | 2007050321 | A2 | 5/2007 |
| WO | 2007096803 | A1 | 8/2007 |
| WO | 2009062542 | A1 | 5/2009 |

* cited by examiner

METHOD OF DRIVING A GAS-DISCHARGE LAMP

CROSS-REFERENCE TO PRIOR APPLICATIONS

This application is the U.S. National Phase application under 35 U.S.C. §371 of International Application No. PCT/IB2012/051020, filed on Mar. 5, 2012, which claims the benefit of European Patent Application No. 11157595.7, filed on Mar. 10, 2011. These applications are hereby incorporated by reference herein.

FIELD OF THE INVENTION

The invention describes a method of driving a gas-discharge lamp, a gas-discharge lamp, and a driver of a gas-discharge lamp.

BACKGROUND OF THE INVENTION

Gas-discharge lamps are often used in lighting applications requiring a very bright light source. One example is a front lighting application, such as in a front headlight of a vehicle. Another example might be the illumination of an interior space such as an underground tunnel. A gas-discharge lamp for such applications is generally driven using AC (alternating current). In a front headlight application using a gas-discharge lamp as light source, a lighting module generally comprises a housing containing a burner and a driver. The term 'burner' includes a discharge vessel, usually of quartz glass and enclosing a fill comprising various metal salts, and an outer vessel that is also usually made of glass. The purpose of the driver is to regulate the lamp current and lamp power. For example, the driver can adjust the frequency and amplitude of the current as well as the level of the lamp power. To this end, a state-of-the-art driver usually comprises various electrical and electronic components such as semiconductor components for performing memory functions, logic functions, etc.

A gas-discharge lamp such as an automotive D5 lamp can easily operate for many thousands of hours under normal operating or environmental conditions. However, under certain circumstances, the temperature in the housing of the lamp may reach extreme levels, and the components of the driver, particularly temperature-sensitive semiconductor components, may not be able to withstand these temperatures. As a result, one or more driver components may become damaged and may even fail, so that the lifetime of the driver (and therefore the lifetime of the lamp itself) is significantly shortened.

One way of dealing with this problem might be to simply arrange the driver at a distance away from the lamp so that it is further away from the high temperatures that originate in the discharge arc and propagate through the electrodes. Alternatively, one or more large heat-sinks could be incorporated in the lamp design. However, in present-day automotive applications at least, a trend towards more compact headlight units means that the housing must also be quite compact. In such a design, the lamp driver must be located in close proximity to the burner. Such a compact design also cannot accommodate a large heat-sink.

In another approach, the lamp power could be reduced in order to also indirectly reduce the thermal load on the electronic components. However, reducing the lamp power, i.e. 'dimming' the lamp, has the direct consequence of lowering the temperature in the coldest spot of the discharge vessel. The term 'coldest spot' is used in its established context, namely to refer to the region in the discharge vessel that is coolest during operation. The coldest spot temperature should be kept as high as possible in order to achieve a desirably high efficacy. When the coldest spot temperature is lowered, the metal salts of the fill can partially condense and are subsequently unavailable in the gas phase, reducing the efficacy of the lamp, wherein efficacy is expressed as a ratio of the luminous flux to the power required to produce that luminous flux, i.e. lumens per Watt. The result is a noticeable drop in light output.

When the lamp power of an AC-driven lamp is reduced to approach a certain minimum, the commutation behaviour of the lamp can start to exhibit unfavourable behaviour. For example, at a zero-crossing of the lamp current, this may remain at or close to zero for a significant duration, so that the discharge arc becomes unstable. This is visible to an observer as a 'flickering' as the light output of the lamp fluctuates. If the lamp power is held at this minimum for too long, the discharge arc will most likely eventually extinguish.

Therefore, it is an object of the invention to provide a way of driving a gas-discharge lamp that avoids the problems described above.

SUMMARY OF THE INVENTION

This object is achieved by the method according to claim 1 of driving a gas-discharge lamp, by the gas-discharge lamp of claim 12, and by the driver of claim 14.

According to the invention, the method of driving a gas-discharge lamp comprises driving the gas-discharge lamp according to conditions in a specific region of the lamp, which gas-discharge lamp comprises a burner in which a first electrode and a second electrode are arranged on either side of a discharge gap, which lamp is realised such that the position of a coldest spot during an AC mode of operation is in the vicinity of the first electrode for a defined mounting position of the lamp, which method comprises the steps of initially driving the lamp in the AC mode of operation; monitoring an environment variable of the lamp, which environment variable is indicative of conditions in a specific region of the lamp; switching to a temporary DC mode of operation at a DC power value on the basis of the monitored environment variable, whereby the first electrode is allocated as the anode; and driving the lamp in the DC mode of operation until the monitored environment variable has returned to an intermediate environment variable threshold value.

Here, the terms 'first electrode' and 'second electrode' are used merely to distinguish one electrode from the other, but do not infer any sequence of handling during a manufacturing process, and do not infer any specific position or arrangement in the lamp. The term 'first electrode' used here and in the following is to be understood primarily to refer to that electrode in whose vicinity the coldest spot tends to develop during a normal AC mode of operation of the gas-discharge lamp.

In an automotive headlamp, a defined mounting position for a gas-discharge lamp is generally a horizontal position in which the electrodes lie essentially along a longitudinal axis of the lamp. In a discharge vessel with an essentially symmetrical internal geometry, the coldest spot during normal AC operation for a horizontally held lamp would be established at a position essentially halfway between the electrodes and near the inside wall of the discharge vessel. The method according to the invention is based on the premise that the coldest spot in an asymmetrical discharge vessel, during normal AC operation of the lamp, is established close to one of the two electrodes, for example at any point along the discharge vessel beneath that electrode. The terms 'close to' and 'in the vicinity of' an electrode is to be interpreted to mean that the coldest spot is not centred around a line passing through a point midway between the electrode front faces, or through any other appropriate 'halfway point', but shows a clear tendency to be established at one or other end of the discharge vessel. This 'coldest spot asymmetry' can be the unavoidable result of constraints in the manufacturing process, but can equally well be the desired result of a specific lamp design. Experiments carried out in the course of the invention showed a surprising correlation between the location of the coldest spot relative to the anode and the efficacy of the lamp during DC operation.

In the known techniques of driving prior art gas-discharge lamps in which a switch-over might be made from AC to DC in order to dim the lamp, for example in response to a user input, the electrode designation can be random, so that there is a 50-50 chance that a particular electrode will function as an anode. In DC operation, the anode is always significantly hotter than the cathode, and the coldest spot is effectively 'pushed' toward the cooler cathode, resulting in a significant drop in the coldest spot temperature. In the case of an asymmetry in the lamp geometry, the coldest spot can tend towards one or other of the electrodes. If it happens that that electrode acts as the cathode, the temperature at the coldest spot will drop even further. The temperature gradient in such a situation is significantly more pronounced and, as a result, the lamp exhibits a significant drop in efficacy when operated in DC. In the known methods of driving a gas-discharge lamp, a changeover to a DC mode of operation can therefore result in a drastically poorer performance. However, a pronounced drop in efficacy, with noticeable drop in light output, is unacceptable for a lamp such as an automotive lamp that must deliver constant light output even if it must be driven for a prolonged duration in DC mode.

With the method according to the invention, the choice of anode ensures that the temperature at the coldest spot can be intentionally and deliberately raised during DC operation so that a condensation of the metal salts is largely prevented, leaving these metal salts available in the gas phase. As a direct result, the efficacy of the lamp is maintained at a favourably high level. In contrast to a prior art method in which the anode function is not allocated to a specific electrode in consideration of a coldest spot asymmetry, resulting in a significant drop in efficacy during a DC mode of operation, the method according to the invention ensures that the lamp efficacy in a DC mode of operation is comparable to that obtainable during an AC mode of operation.

Another advantage of the method according to the invention is that the lamp power can be reduced to a much further level than would be possible during a purely AC mode of operation, particularly for a lamp with a low nominal power, for example a 25 W lamp. During operation in the DC (direct current) mode, the lamp current does not commutate, but remains at a relatively constant level, so that unstable commutation behaviour is not an issue. The DC mode of operation can persist essentially indefinitely until the monitored environment variable has returned to a satisfactory value, at which point the AC mode of operation can be resumed. The method according to the invention advantageously allows the lamp power to be regulated according to the environment variable, which can indicate deteriorating, stable or improving conditions. In this way, damage in a critical region of the lamp as a result of unfavourable conditions can easily and effectively be forestalled. As a result, the lamp lifetime, which may be directly influenced by the environment variable, can be prolonged. The lamp need only be driven in the temporary DC mode until the monitored environment variable has returned to an acceptable threshold value, after which the lamp can be driven again in an AC mode of operation.

According to the invention, the gas-discharge lamp comprises a burner in which a first electrode and a second electrode are arranged on either side of a discharge gap, which lamp is realised such that the position of a coldest spot during an AC mode of operation is in the vicinity of the first electrode; and which lamp comprises a driver for driving the lamp according to conditions in a specific region of the lamp, which driver is realised to initially drive the lamp in an AC mode of operation; monitor an environment variable of the lamp, which environment variable is indicative of conditions in a specific region of the lamp; switch to a temporary DC mode of operation at a DC power value on the basis of the monitored environment variable, and thereby to allocate the first electrode as anode; and to drive the lamp in the DC mode of operation until the monitored environment variable has returned to an intermediate environment variable threshold value.

An advantage of the gas-discharge lamp according to the invention is that the coldest spot temperature during the temporary DC mode of operation is maintained at a favourably high level, so that the lamp can be driven for a prolonged duration in this temporary DC mode of operation without a noticeable loss in light output at a comparable AC power level. Another advantage is that the lamp can effectively be protected from failure that might otherwise result from adverse or progressively worsening environmental conditions, since it can react to a worsening environment variable by effecting a changeover from AC to DC, and can maintain DC operation until the environment variable has returned to an acceptable or 'safe' level. In other words, the gas-discharge lamp according to the invention can, by regulating the lamp power as appropriate, effectively prevent damage that would otherwise occur as a result of adverse environment conditions.

According to the invention, the driver for a gas discharge lamp—comprising a burner in which a first electrode and a second electrode are arranged on either side of a discharge gap, which lamp is realised such that the position of a coldest spot during an AC mode of operation is in the vicinity of the first electrode—comprises an environment variable input for obtaining an environment variable value; a memory for storing a plurality of environment variable threshold values; and a comparator for comparing a monitored environment variable to an environment variable threshold value. The driver is realised to initially drive the lamp in an AC mode of operation; monitor an environment variable of the lamp, which environment variable is indicative of conditions in a specific region of the lamp; switch to a temporary DC mode of operation at a DC power value on the basis of the monitored environment variable, and thereby to allocate the first electrode as anode; and to drive the lamp in the DC mode of operation until the monitored environment variable has returned to an intermediate environment variable threshold value.

Such a driver can be used to replace a prior art driver of an existing lamp of an appropriate type, so that the lamp can be used to good effect even under very unfavourable environment conditions.

The dependent claims and the subsequent description disclose particularly advantageous embodiments and features of the invention. Further embodiments may be derived by combining the features of the various embodiments described below, and features of the various claim categories can be combined in any appropriate manner.

The environment variable can be any variable which gives a reliable indicator of the conditions in a critical region of the lamp. As mentioned in the introduction, components of the driver may fail if these are subject to adversely high temperatures for an extended period of time. Therefore, the step of monitoring an environment variable preferably comprises measuring a variable that gives a reliable indication of the conditions prevalent in a critical region of the lamp, for example the conditions in the driver. The environment variable can be monitored or tracked indirectly. For example, an operating variable such as the input ballast voltage can be monitored, since such an operating variable is usually monitored anyway in a lamp driver, and the observed values can be compared to data collected during a previous calibration stage in order to draw the appropriate conclusion regarding the environment variable. For example, by monitoring the input ballast voltage and using a previously established input ballast voltage/driver temperature relationship, it may be possible to deduce the probable temperature in a critical region of the driver for any value of input ballast voltage. Any appropriate environment variable could be monitored, as long as the chosen environment variable can act as a reliable indicator of the conditions prevalent in the critical region of the lamp. For example, a progressively decreasing input ballast voltage might also indicate that the lamp is being operated under progressively worsening environmental conditions. Alternatively, the environment variable may be measured or monitored directly, for example a temperature may be directly measured in a specific critical region of the lamp. Of course, any appropriate or suitable other variable could be monitored. For example, the lamp current may be a suitable choice of environment variable, since this also varies as the lamp lifetime progresses, and can therefore also give an indication as to how far the lamp power can safely be reduced for an older lamp. Other suitable candidate for an environment variable may be the battery voltage, since an alteration in the battery voltage can indicate a corresponding alteration in the current being drawn by the lamp, which in turn can be indicative of worsening or improving environmental conditions in the critical region of the lamp.

Preferably, the burner of the gas-discharge lamp according to the invention is arranged on a base, and the two electrodes are preferably arranged along a longitudinal axis of the burner such that the first electrode is at a position remote from the base and the second electrode is at a position close to the base. In the following, the terms "inner" and "outer" are used in relation to the positions of the electrodes relative to the lamp base, since, for automotive purposes, the burner is generally mounted essentially perpendicularly in the base with the optical axis of the burner at a right angle to the base.

In a compact lamp design, the components of a lamp driver can be arranged in a housing positioned at the base end of the lamp, close to the lamp itself. For example, a base-side driver housing can be enclosed in a lamp socket so that an overall compact lamp/driver realization is possible. Therefore, in the method according to the invention, when a temperature is used as the environment variable, the temperature is preferably measured within such a housing, so that the temperature in the driver is reliably monitored. In the following, for the sake of simplicity, but without restricting the invention in any way, it may be assumed that the environment variable is a temperature, and that the temperature is measured close to the driver, for example in such a base-side driver housing.

Experiments carried out in the course of this invention have shown that the choice of electrode and consideration of lamp asymmetry are significant factors in maintaining a satisfactory coldest spot temperature during DC mode. Therefore, in a particularly preferred embodiment of the invention, the electrode situated at a position remote from the base is allocated to act as the anode during the DC mode of operation. To ensure this, the driver can apply a potential difference across the electrodes such that the voltage applied to the outer electrode (which is to act as anode) is greater than the voltage applied to the inner electrode (which will act as cathode). The driver could be 'hard-wired' to always choose one particular electrode as anode, for example the 'outer' electrode that extends along the outside of the lamp into the base. However, since there are many ways of designing and constructing a gas-discharge vessel, the driver preferably comprises a memory for storing an anode specification flag, which anode specification flag indicates which electrode—inner or outer—of the electrode pair is to be driven as anode during a DC mode of operation, whereby the anode specification flag specifies the electrode in the vicinity of which the coldest spot is generally established in AC operation. In a switch-over from AC to DC with the most suitable electrode acting as anode, the coldest spot temperature can be maintained at a high level, so that a condensation of the metal salts is avoided during dimming, and the lamp efficacy can be maintained at a favourably high level.

The switch-over to DC is preferably performed after the lamp power has been reduced to a certain level which is low enough to ensure that the DC operation is stable and that the electrodes are not subject to an excessive level of thermal stress. Therefore, the DC power value at the switch-over to the temporary DC mode of operation is preferably lower than an AC lamp power value essentially immediately preceding the switch-over. For example, once a certain temperature has been exceeded during operation of the lamp at nominal power, the lamp driver may switch to a DC mode of operation.

Therefore, in a preferred embodiment of the invention, the switch-over to the temporary DC mode of operation is preceded by a reduction of the AC lamp power on the basis of the monitored environment variable. If a measured environment variable passes beyond a certain threshold, the AC lamp power could first be gradually reduced, for example by ramping it downwards by very small decrements, and making the changeover at some point from AC to DC. In a further preferred embodiment of the invention, the AC lamp power is reduced to a defined AC power lower limit value before making the switch-over to the DC mode of operation. The AC power lower limit may depend on various factors, for example it may be defined on the basis of the lamp specification, or may be chosen according to desired lifetime properties and/or desired commutation behaviour of the lamp. A desired lifetime property may be, for example, the lamp voltage as the lamp lifetime progresses.

In a preferred embodiment of the invention, the AC power lower limit value comprises at most 92%, more preferably at most 84%, and most preferably at most 72% of the nominal power of the lamp. For the case of a 25 W lamp, the AC power lower limit value is therefore preferably in the range of 23 W-18 W, whereby the lower 18 W level is the most preferred AC power lower limit value.

It may be that the lamp current at the point of switching can be considerably higher than an acceptable level for DC operation, which would result in the electrodes being subject to a very high thermal load. The result might be a severe burn-back of the electrode front faces as these melt on account of the very high temperatures. Apart from the obvious drawback caused by such a burn-back—namely a drop in luminous flux as a result of the longer discharge arc—the deformation of the electrodes can also result in a significant shortening of the lamp lifetime. Therefore, in a particularly preferred embodiment of the invention, at a switch-over from AC mode of operation to DC mode of operation, the lamp power is abruptly decreased from the AC power lower limit value to an even lower power value, so that the lamp current is also abruptly decreased to a level appropriate for DC operation and low enough to avoid any significant electrode deformation and thermal load on the pinch. The expression "abrupt decrease" is to be understood to mean a marked or significant decrease, in contrast to a gradual decrease such as a ramping down of the lamp power. The magnitude of the abrupt decrease can depend on the lamp type. Preferably, the step of abruptly decreasing the lamp power comprises decreasing the lamp power to a DC lower power value which is ultimately at most 84%, more preferably at most 72%, most preferably at most 60% of the lamp nominal power. For a 25 W lamp, the lamp power would ultimately be reduced to 21 W, 18 W, or even down to 15 W respectively. The 'power gap' or magnitude of the abrupt decrease can be expressed as a percentage of the lamp nominal power, for example the power gap can comprise at most 8%, more preferably by at most 4%, and most preferably by at most 2% of the lamp nominal power value. For example, for a 25 W lamp, the DC power value is preferably at most 1 W, more preferably only 0.5 W less than the AC power lower limit value. The magnitude of the step can be given by a predefined value, for example a value of 0.75 W below the AC lower power limit. If the AC lower power limit comprises a fixed value, the lower DC value can be defined by the AC lower power limit and the step magnitude.

As mentioned above, the method according to the invention allows the lamp power to be reduced during the DC mode of operation to a level considerably lower than that which would be practicable during an AC mode of operation. However, reducing the DC lamp power too far might cause the discharge arc to extinguish. Therefore, in a further preferred embodiment of the invention, the step of driving the lamp in the DC mode of operation comprises reducing the lamp power to a DC power lower limit, after which the lamp power is either maintained at that DC power lower limit, or is increased gradually back to a higher DC power level. For the 25 W lamp given in the above examples, an appropriate DC power lower limit might comprise 18 W or even 15 W.

At some point, when the environment variable has returned to an acceptable level, a switch-over from the temporary DC mode back to the AC mode of operation can be carried out. For example, such a switch-over can preferably be carried out when the return to AC is likely to be 'permanent', i.e. when lamp can be driven in the AC mode again, without a worsening of the environmental variable. However, if the increasing lamp power were to trace the same path as the decreasing lamp power, only in reverse, the driver might become caught in an endless corrective loop about an unstable operating point. In such a situation, the temperature can decrease (a favourable development), so that the driver increases the lamp power with a corresponding increase in lamp current; as a result the temperature increases (an unfavourable development) so that the driver decreases the lamp power with a corresponding decrease in lamp current; as a result the temperature decreases, etc., etc. Such an endless corrective loop is very undesirable. Therefore, a particularly preferred embodiment of the method according to the invention comprises the step of switching back from the temporary DC mode of operation to the AC mode of operation when the monitored environment variable has returned to an intermediate or return threshold value, which return threshold value is significantly different from the value of the environment variable at which the changeover was made from AC to DC. For example, if the environment variable is a temperature, a switch-over from the DC mode of operation to the AC mode of operation is preferably carried out at a significantly lower temperature than the temperature at which the switch-over was made from the AC mode of operation to the DC mode of operation.

When power is plotted or graphed as a function of temperature, the power curve exhibits a degree of hysteresis, since the DC-to-AC return path is different from the AC-to-DC path. This will be shown later with the aid of the drawings. The intermediate or return threshold value can be determined in a prior calibration step for that lamp type under real or simulated adverse conditions, and can indicate a level at which it can safely be assumed that a return to the AC mode of operation is likely to be 'permanent', at least for the foreseeable future.

When switching back from DC to AC, the lamp current must be high enough in order for a stable discharge arc to be maintained. Therefore, in a further preferred embodiment of the invention, at a switch-over from DC mode of operation to AC mode of operation, the lamp power (and therefore also the lamp current) is abruptly increased from the lower power value to a higher power value. This 'upward' power step is preferably significantly greater than any 'downward' power step included in the changeover from AC to DC. In a particularly preferred embodiment of the invention, the return power value exceeds the AC power lower limit value by at least 2%, more preferably by at least 4% of the lamp nominal power. In this way, the lamp power is more quickly brought back to the nominal lamp power level, while at the same time, due to the hysteresis nature of the lamp control, the lamp driver will not be caught at an unstable operating point or working point as described above.

The temperature distribution in the discharge vessel or discharge chamber plays a significant role during operation of the lamp. It is important that the coldest spot is relatively high, since a low coldest spot temperature is related to a drop in efficacy of the lamp. By keeping the coldest spot temperature at a relatively high level, therefore, a higher efficacy can be achieved. In the gas-discharge lamp according to the invention, the electrode near which the coldest spot would normally be established in an AC mode of operation is the preferred choice of anode. By using that electrode as the anode, the temperature gradient in the discharge vessel of the burner can be kept favourably low. The tendency of the coldest spot to develop closer to one electrode than the other is due to an asymmetry in the lamp. Knowing that such an asymmetry exists, the development of the coldest spot could be monitored during normal AC operation of the lamp to identify the electrode nearest the coldest spot, and that electrode is chosen in the method according to the invention to act as anode during a DC mode of operation.

Preferably, the manufacturing process according to the invention deliberately introduces an asymmetry so that, during operation of the lamps thus manufactured, the coldest spot essentially always develops in the vicinity of one particular electrode. In other words, these lamps exhibit what may be called a "coldest spot asymmetry" during AC operation, meaning that the coldest spot in these lamps does not develop at a central location, at a location between the electrodes, or any such "middle location". Instead, for lamps of the same series manufactured using the same manufacturing process according to the invention, the coldest spot will reliably and reproducibly develop closer to one particular electrode. This is the electrode (termed the "first electrode" in the above) that will be used as the anode when a switch-over is made from AC to DC in the method according to the invention. Such a manufacturing process according to the invention is described in the following.

In the manufacture of a discharge vessel for a gas-discharge lamp, a quartz glass tube is formed and heated. The tube is sealed at one end by pinching the molten quartz, and an electrode is enclosed in that pinch at the same time, so that one end of the electrode extends into the open tube. Fill material in the frozen (solid or gaseous) state, comprising for example Xenon and pellets of various metal salts, is then dropped into the open tube, which is subsequently sealed to prevent the fill from escaping, while at the same time enclosing a further electrode. Another pinch is formed at that end of the tube. In this way, a small discharge chamber is formed, and the electrodes protrude into the discharge chamber from opposite ends. The electrodes are arranged to lie along the optical axis of the burner, and their front faces are separated by a small gap. Because the pinches are formed in separate steps, and since the fill material also heats and expands when the second pinch is being formed, the fill gas exerts a pressure on the second pinch area while sealing. For this reason, a discharge vessel manufactured in this manner exhibits a certain degree of asymmetry. For example, the asymmetry can result in a slightly longer exposed length of one electrode. The 'exposed length' is the length of electrode exposed in the discharge chamber between tip and pinch. Experiments with such gas-discharge lamps driven using the method according to the invention have shown that the electrode with the slightly longer exposed length is very well suited as anode, since the longer exposed length improves the behaviour of that electrode under thermal load. Therefore, in a particularly preferred embodiment of the gas-discharge lamp according to the invention, the manufacturing process is configured such that a gas-discharge lamp comprises a discharge chamber sealed by two pinches, whereby one pinch is formed such that a length of the electrode extending through that pinch into the discharge chamber is greater than the length of the electrode extending through the other pinch into the discharge chamber. To use the terminology established above, an electrode with such a longer exposed length can be the 'first electrode', since the coldest spot will tend to develop in its vicinity. The asymmetry resulting from the difference in electrode exposed length is generally so slight as to be invisible to the naked eye.

For a gas-discharge lamp according to the invention, the asymmetry can be deliberately introduced into the lamp design so that the coldest spot during AC operation tends toward one particular electrode, as described above, and this asymmetry can be exploited by the driver, which applies a DC voltage across the electrodes such that that particular electrode performs as the anode. In a preferred embodiment of the gas-discharge lamp according to the invention, therefore, the lamp comprises two electrodes arranged to face each other along a longitudinal axis of the burner across a short gap, which gap is offset along the longitudinal axis towards the base of the lamp. The 'outer' or first electrode has a longer exposed length, while the 'inner' or second electrode, closest to the base, has a shorter exposed length. This could also be achieved by 'shifting' or offsetting the electrodes along the longitudinal axis towards the inner end of the burner, so that the electrode gap is then no longer positioned essentially in the centre of the burner, but is offset a little towards the base of the lamp. Either way, the outer or first electrode is better suited to its function as anode after a switch-over is made from an AC mode of operation to a DC mode of operation.

Preferably, in the gas-discharge lamp according to the invention, the inner electrode and the outer electrode have essentially equal dimensions, i.e. their diameters and their end-to-end lengths (from Mo-foil to electrode tip) are essentially the same.

To track the development of the environment variable during operation of the lamp, the gas-discharge lamp according to the invention preferably comprises a suitable monitoring unit for monitoring the environment variable, which monitoring unit is realised to provide the lamp driver with an environment variable value. This monitoring unit can be located at any suitable position, preferably such that it can monitor the variable in a critical region such as a socket region. Preferably, the monitoring unit comprises a temperature sensor, since a direct measurement of the temperature can provide a reliable report of the situation in the critical region, and the driver can react accordingly. Of course, such a monitoring unit could also be incorporated in the driver. Other monitoring means are conceivable. For example, an infrared sensor could be used to monitor the temperature development in the lamp and to determine the location of the coldest spot. In another embodiment, a pair of sensors could be used to monitor a temperature gradient across the lamp, for example by measuring the temperature at each end of the lamp or at each electrode.

Other objects and features of the present invention will become apparent from the following detailed descriptions considered in conjunction with the accompanying drawings. It is to be understood, however, that the drawings are designed solely for the purposes of illustration and not as a definition of the limits of the invention.

BRIEF DESCRIPTION OF THE DRAWINGS

In the drawings, like numbers refer to like objects throughout. Objects in the diagrams are not necessarily drawn to scale.

DETAILED DESCRIPTION OF THE EMBODIMENTS

Figure 1:
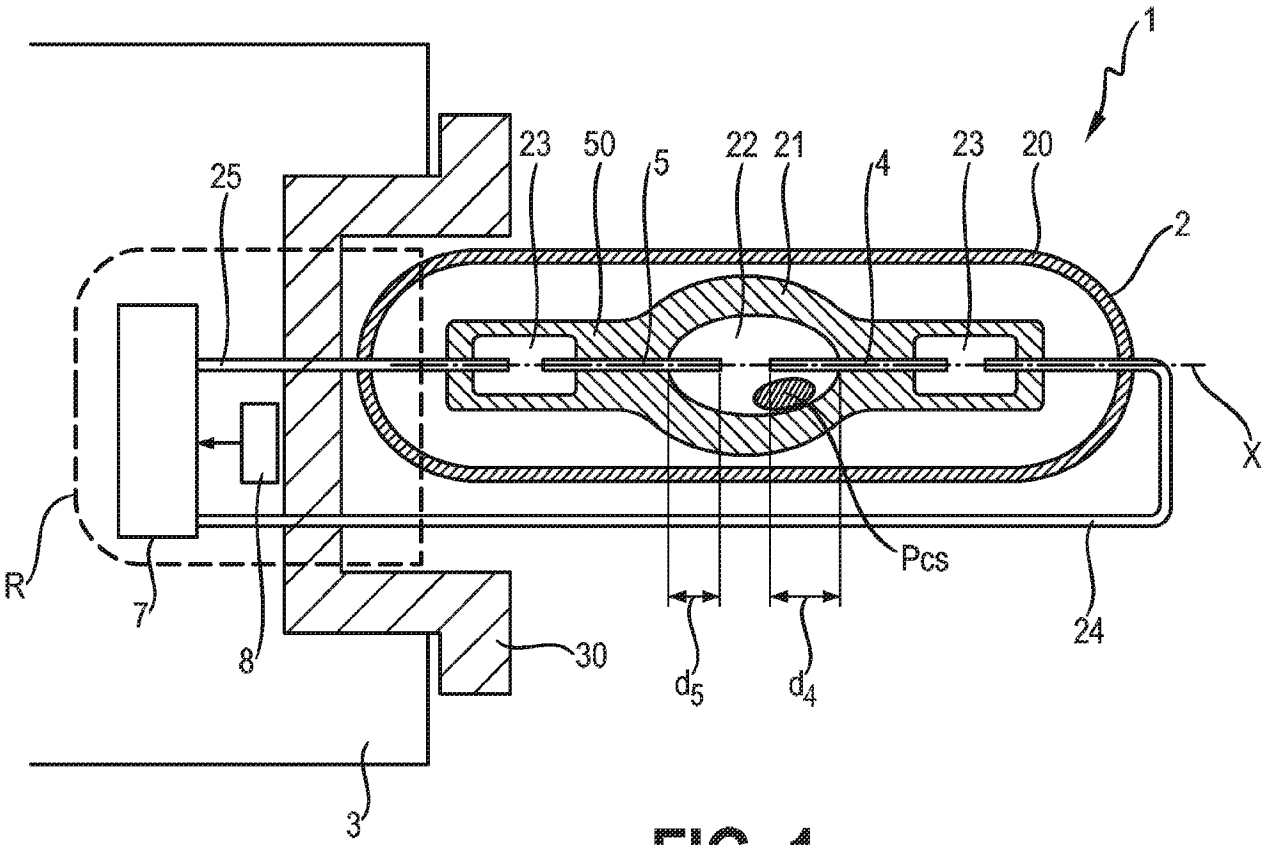
FIG. 1 shows a gas-discharge lamp according to an embodiment of the invention.

FIG. 1 shows a gas-discharge lamp 1 according to an embodiment of the invention. The lamp 1 comprises a burner 2 mounted in a base 3. In an automotive front lighting arrangement, such a lamp 1 is generally mounted horizontally in a housing so that the longitudinal axis X of the burner 2 is essentially horizontal. The burner 2 comprises an outer glass vessel 20 enclosing an inner discharge vessel 21. The discharge vessel 21, usually a quartz glass bulb 21, comprises a pair of electrodes 4, 5 arranged along the optical axis X to face each other across a short gap in a discharge chamber 22, which is sealed by two pinches 40, 50. The exposed length $d_4$ of the outer electrode 4 is slightly longer than the exposed length $d_5$ of the inner electrode 5. This can be the result of a deliberate 'shifting' of the electrodes along the longitudinal axis of the burner to offset the gap that separates the front faces of the electrodes towards the base of the lamp. Alternatively, the longer exposed length may be the result of the manufacturing process, in which a first pinch is formed before introducing a filling and forming the second pinch. The result is an asymmetrical shape of the discharge chamber, being essentially conical or pointed at one end (the outer end in this diagram) and more rounded at the other end.

Each electrode 4, 5 is connected to a molybdenum foil (Mo-foil) 23 in a pinch 40, 50. Each foil 23 in turn is connected to an outer electrode lead 24, 25. The outer electrode leads 24, 25 are connected to relevant components of a driver 7 located in the base 3. In this lamp design, with the 'longer' end of the discharge vessel at the outer electrode, the asymmetry in the discharge chamber results in the coldest spot $P_{CS}$ being established in the neighbourhood of the outer electrode, as indicated in a very simplified manner by the shaded area. As mentioned above, such a lamp asymmetry is generally so slight as to be invisible to the naked eye.

Because of the very high temperatures reached in the discharge chamber 22 during operation of the lamp, the electrode leads 24, 25 also become very hot. The components of the driver 7 also heat up. The confined space in the base (and the surrounding lamp housing, which is not shown) means that this heat cannot be quickly dissipated from this critical region R, indicated by the broken line. Should the temperature in the critical region R reach an unfavourably high level, some components of the driver 7 may be damaged, which could well result in lamp failure. Therefore, the lamp 1 according to the invention comprises a monitoring unit 8 located at a position in the base 3 at which it can reliably monitor the environment variable. In this embodiment, the monitoring unit 8 is realised to measure the temperature close to a region at which the electrode leads 24, 25 are connected to the driver 7, and to deliver an environment variable value 88 to the driver 7. The driver 7 can regulate the lamp power to drive the lamp 1—either in an AC mode of operation or a DC mode of operation—according to the environment variable value 88.

Figure 2:
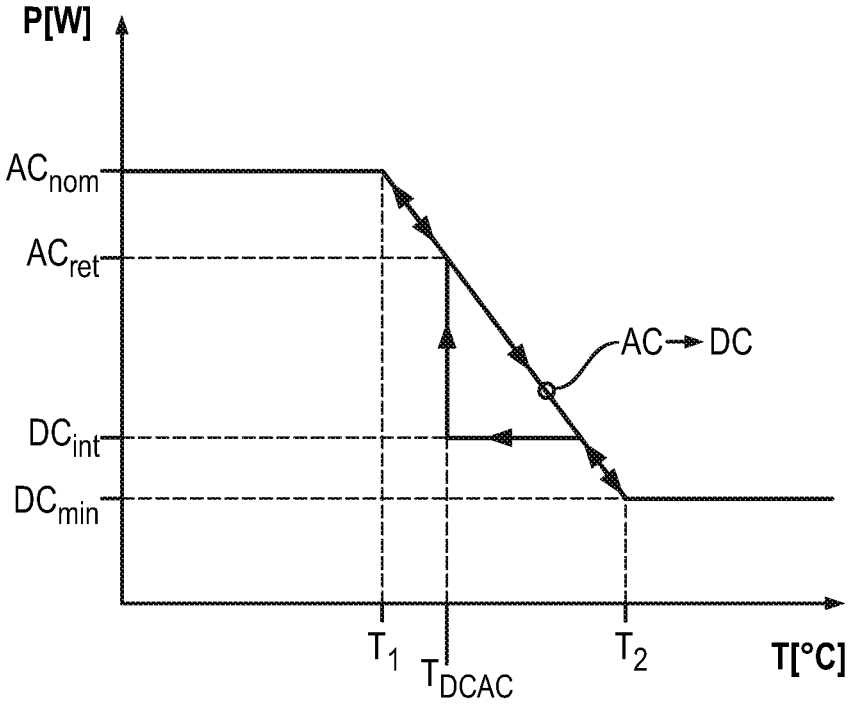
FIG. 2 shows a first graph of power against temperature for the lamp of FIG. 1 driven using the method according to the invention.

For an automotive D5 high intensity gas-discharge (HID) lamp, the nominal power $AC_{nom}$ is 25 W. Using the method according to the invention and a monitored environment variable, the lamp can be driven initially in AC mode. If the temperature measured in the lamp base exceeds a first threshold $T_1$ of a specified value (e.g. a temperature of around 120° C. measured in the housing), the lamp driver can commence gradual reduction of the lamp power, and eventually make a switch-over to a temporary DC mode, as illustrated by FIG. 2, which shows a first graph of power P (in Watts) against temperature T (in degrees Celsius) for the lamp 1 of FIG. 1 driven using the method according to the invention. In the temporary DC mode of operation, the outer electrode 4 is given the function of anode. Here, the monitoring unit 8 measures the temperature and delivers temperature values to the driver. Initially, the lamp is driven in AC mode at the nominal operating power $AC_{nom}$ for that lamp. During operation of the lamp, the temperature in the critical region can increase. Beyond a certain first temperature threshold $T_1$, the driver steadily reduces the AC lamp power in small decrements, for example by ramping the power downwards. The AC power is not reduced below a level beyond which the commutation behaviour of the lamp would become unstable. If the monitored temperature still shows a tendency to increase, the driver switches over at some point—indicated by the small circle on the graph—from the AC mode of operation into a DC mode of operation. This instant may be governed by the lamp power value, or by the monitored temperature value, as appropriate. At the same time, the DC voltage is applied across the electrodes such that the outer electrode 4 of the lamp 1 of FIG. 1 acts as the anode, and the inner electrode 5 acts as the cathode. In this way, the temperature at the coldest spot can be increased, since the anode becomes significantly hotter than the cathode during DC operation of a gas-discharge lamp. Because of the large proportion of metal salts still available in the gas phase as a result of the higher coldest spot temperature, the lamp efficacy is therefore maintained at a favourably high level during the temporary DC mode. The driver can decrease the lamp power by ramping it downwards, as shown here, to a minimum DC power level $DC_{min}$. This power level $DC_{min}$ is then maintained, during which the temperature may increase for a while. Eventually, the temperature will start to fall again. Once the temperature has fallen to an acceptable level $T_2$, the driver can gradually increase the DC lamp power. Once an intermediate DC power level has been reached, for example the lower power level $DC_{int}$, the driver maintains this power level $DC_{int}$ until the temperature has fallen further to an intermediate or return value $T_{DCAC}$. This intermediate or return value $T_{DCAC}$ is chosen to be significantly lower than the value at which the changeover was made from AC mode to DC mode. At this point, the driver switches back to an AC mode of operation, and at the same time abruptly increases the lamp power to a return value $AC_{ret}$ so that the lamp current is high enough for a satisfactory commutation behaviour and a satisfactory light output. After returning to AC mode, the driver can continually increase the AC lamp power towards the nominal power level $AC_{nom}$ as long as the temperature continues a downward tendency. Once a satisfactory temperature has been reached, the lamp can be driven at its nominal power level $AC_{nom}$ again.

Figure 3:
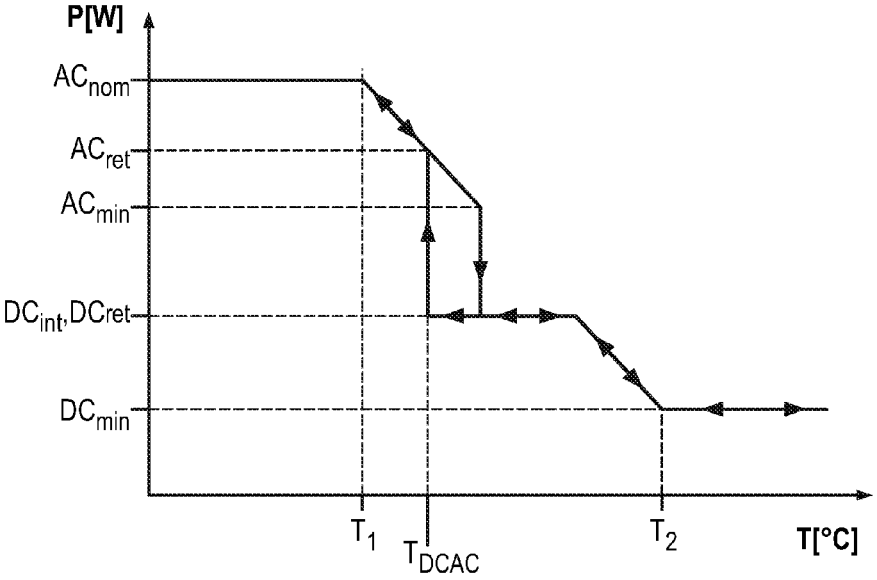
FIG. 3 shows a second graph of power against temperature for the lamp of FIG. 1 driven using the method according to the invention.
Figure 4:
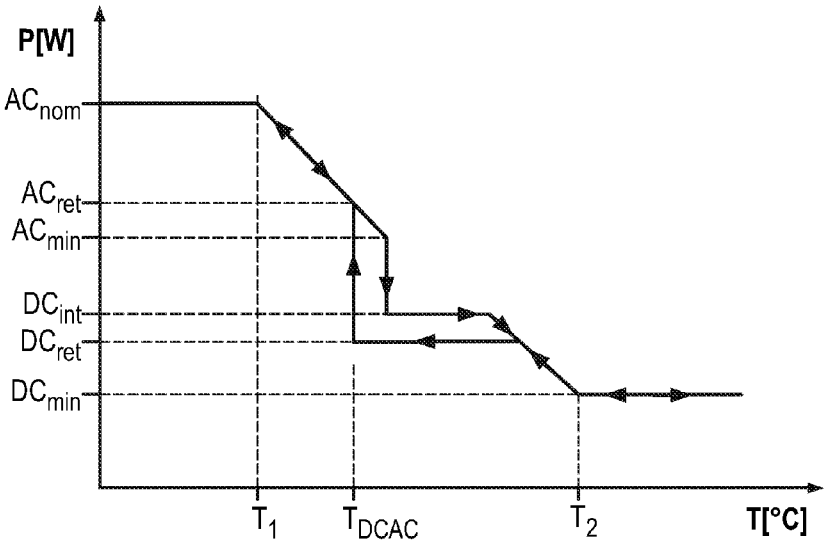
FIG. 4 shows a third graph of power against temperature for the lamp of FIG. 1 driven using the method according to the invention.

FIGS. 2-4 show the "path" travelled by the lamp power as a function of temperature. At any point during operation of the lamp, the "direction of travel" (indicated by the arrowheads) can be reversed as the temperature reverses its trend, for example if the temperature starts to increase again after having shown a downward tendency for a while. To ensure a satisfactorily stable power control, several temperature measurements can be obtained in succession over a predefined length of time to determine a temperature trend before carrying out an appropriate lamp power adjustment.

FIG. 3 shows another graph of power P as a function of temperature T for a 25 W lamp driven using the method according to the invention. Beyond a first temperature $T_1$, the driver gradually reduces the AC lamp power. Here, when the AC power has reached an AC power lower limit $AC_{min}$, the power is abruptly lowered from the AC power lower limit $AC_{min}$ to a lower power level $DC_{int}$, in order to also significantly reduce the lamp current so that it is low enough to avoid subjecting the electrodes to an excessive thermal load. If the temperature continues to increase at this lower power level $DC_{int}$, the driver can proceed to lower the DC power steadily, for example by ramping it downwards, as shown here, to a minimum DC power level $DC_{min}$.

In this example, the driver lowers the AC power to a minimum AC level $AC_{min}$ of about 21 W, about 84% of nominal power, before switching to DC mode (with outer electrode as anode) and abruptly decreasing the lamp power to a lower power level $DC_{int}$, which can be about 15 W, or about 60% of nominal power. This type of lamp could not be driven at such a low power level in the AC mode of operation, since the discharge arc would eventually extinguish as a result of poor commutation behaviour. In the lamp according to the invention, the rather low DC power level $DC_{int}$ can be maintained for a while, but should of course only be maintained for a limited duration, since it should be regarded as a kind of 'emergency' mode, used only to counteract the potentially damaging effects of an extreme environment variable such as a too-high temperature in a driver housing. The low DC power level should preferably be maintained only as long as necessary, using an improvement of the environment variable to return towards a normal mode of operation.

Once the temperature drops below the threshold temperature $T_2$, the DC power can be gradually ramped up again until it reaches a predefined return value $DC_{ret}$, which in this case coincides with the intermediate value $DC_{int}$. This DC value $DC_{int}$ is maintained until the temperature reaches a return threshold value $T_{DCAC}$ at which point the driver abruptly increases the lamp power to a return AC power value $AC_{ret}$ that is higher than the AC power lower limit value $AC_{min}$.

The 'gaps' between the higher and lower lamp power values, e.g. the difference between the lower power value $DC_{ret}$ and the higher power value $AC_{ret}$ in FIG. 2; or the difference between the higher power value $AC_{min}$ and the lower power value $DC_{int}$ in FIG. 3, are characteristic of the hysteresis applied by the control loop of the lamp driver to ensure that it cannot be 'caught' in an endless corrective loop about an unstable operating point, as explained above.

FIG. 4 shows a third graph of power against temperature for the lamp of FIG. 1 driven using the method according to the invention. This curve shows a variation of the power control algorithm employed by the driver. Instead of increasing the DC lamp power t the intermediate DC power level $DC_{int}$, the driver increases the DC power to a lower value $DC_{ret}$ and maintains this power level until the temperature has dropped to a satisfactory intermediate value $T_{DCAC}$, whereupon the driver abruptly increases lamp power to a return AC power value $AC_{ret}$ that is higher than the AC power lower limit value $AC_{min}$. Of course, other variations are possible. For example, the lamp could be driven such that the return power level $DC_{ret}$ would be higher than the intermediate power level $DC_{int}$.

Figure 5:
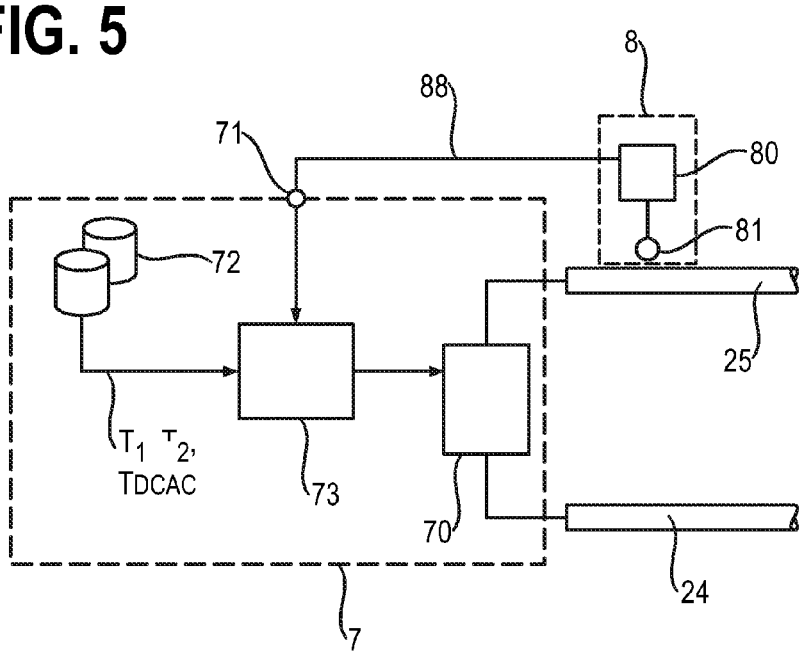
FIG. 5 shows a block diagram of a driver according to the invention.

FIG. 5 shows a simplified block diagram of a driver 7 according to the invention. Here, a commutation unit 70 of the driver 7 is connected to the outer electrode leads 24, 25 of the lamp (not shown in the diagram). The commutation unit 70 can apply an AC voltage across the leads 24, 25, but can also apply a DC voltage. The diagram also shows a monitoring unit 8 with a temperature sensor 81 positioned close to one of the electrode leads. A conversion unit 80 connected to the temperature sensor 81 provides an environment variable value 88 in a suitable form for the driver 7. The environment variable value 88 is received by the driver 7 at a suitable input 71 and compared in a comparator 73 to predefined threshold values $T_1$, $T_2$, $T_{DCAC}$ stored in a memory 72. The comparator 70 can indicate to the commutation unit 70 when the lamp power should be increased, decreased, maintained, etc. Of course, the commutation unit 70 will contain various components such as logic components, transistors, a voltage measurement unit, a current measurement unit etc., as will be known to the skilled person. The monitoring unit 8, or just the conversion unit 80, could of course be realised as part of the driver 7.

The hysteresis exhibited by the lamp power as a function of temperature has been shown to comprise an abrupt 'vertical' increase in lamp power when returning from the AC mode to the DC mode of operation, and maybe also an abrupt 'vertical' decrease in lamp power when making the changeover from DC to AC. Of course, the change in lamp power at these points could be made less abrupt. For example, when changing over from DC to AC, the lamp power could be ramped up steeply while allowing the temperature to sink slightly further, so that the plotted power increase shows a steep slope instead of being 'vertical'. The same applies in principle to the changeover from AC to DC, in which the power could be ramped down steeply while allowing the temperature to increase.

Figure 6:
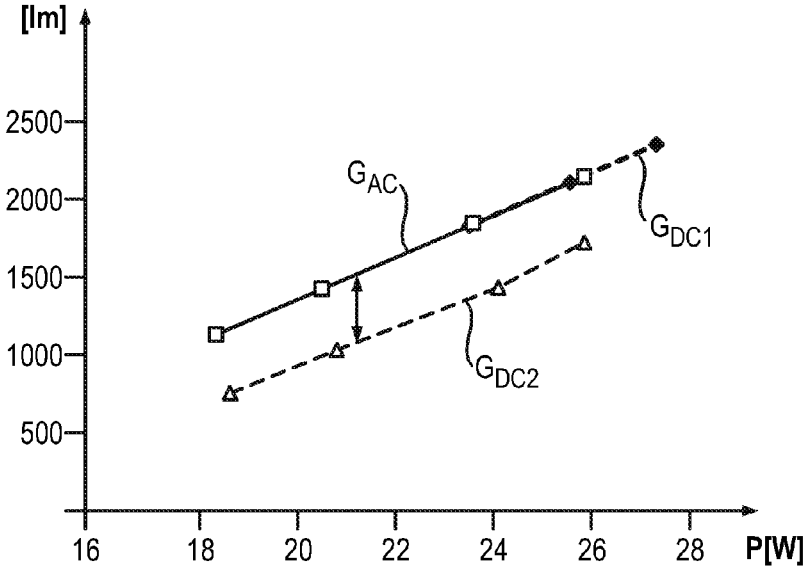
FIG. 6 shows graphs of luminous flux against lamp power for a gas-discharge lamp driven using the method according to the invention.

FIG. 6 shows graphs $G_{AC}$, $G_{DC-1}$, $G_{DC-2}$ of luminous flux G (lm) against lamp power P (Watt) for a 25 W D5 gas-discharge lamp. A first graph $G_{AC}$ (dotted line with diamond-shaped markers to indicate measurement values) shows the luminous flux for the lamp driven in AC mode. To determine the power/flux dependency, the lamp was driven briefly at power levels above the rated power, up to about 28 W. As the lamp power was decreased from about 28 W to about 19 W, the luminous flux was observed to decrease from about 2400 lm to about 1300 lm. When a lamp in which the coldest spot is located at the outer end owing to asymmetry in the discharge vessel is driven using the method according to the invention so that the outer electrode acts as the anode, the luminous flux follows a second graph $G_{DC-1}$ (solid line with square markers to indicate measurement values), which essentially follows the same path as the first graph $G_{AC}$. As this graph shows, the lamp can be driven in DC mode at reduced lamp power without any noticeably worse efficacy than in AC mode at reduced lamp power. This is because the coldest spot temperature is raised by the hotter anode. An improvement of up to 500 lumen (indicated by the vertical line between the graphs) was observed over the prior art methods. In contrast, for a lamp with or without such an asymmetry and driven in DC with the inner electrode acting as cathode, the lamp exhibits a marked drop in luminous flux, as indicated by the third graph $G_{DC-2}$ (dashed line with triangular markers to indicate measurement values). For an essentially symmetrical discharge vessel, for example, the coldest spot will be more or less halfway along the discharge vessel during AC mode, but will be displaced toward the cooler cathode during DC mode, with a resulting pronounced temperature gradient. For an asymmetrical discharge vessel with its coldest spot closer to the inner electrode, and with the outer electrode acting as anode, the temperature gradient becomes more pronounced in a DC mode of operation. Again, the result is a drop in lamp efficacy.

Although the present invention has been disclosed in the form of preferred embodiments and variations thereon, it will be understood that numerous additional modifications and variations could be made thereto without departing from the scope of the invention. For the sake of clarity, it is also to be understood that the use of "a" or "an" throughout this application does not exclude a plurality, and "comprising" does not exclude other steps or elements.

The invention claimed is:

1. A method of driving a gas-discharge lamp according to conditions in a specific region of the lamp, which gas-discharge lamp comprises a burner in which a first electrode and a second electrode are arranged on either side of a discharge gap, which lamp is realised such that the position of a coldest spot during an AC mode of operation is in the vicinity of the first electrode, which method comprises the steps of initially driving the lamp in the AC mode of operation;

monitoring an environment variable of the lamp, which environment variable is indicative of conditions in the specific region of the lamp;

switching to a temporary DC mode of operation at a DC power value on the basis of the monitored environment variable, whereby the first electrode is allocated as the anode; and driving the lamp in the DC mode of operation until the monitored environment variable has returned to an intermediate environment variable threshold value.

2. A method according to claim 1, wherein the burner is arranged on a base, and the electrodes are arranged in the burner such that the first electrode is at a position remote from the base.

3. A method according to claim 1, wherein the switch-over to the temporary DC mode of operation is preceded by a reduction of the AC lamp power on the basis of the monitored environment variable.

4. A method according to claim 3, wherein the AC lamp power is reduced to an AC power lower limit value.

5. A method according to claim 4, wherein the AC power lower limit value comprises at most 92%, more preferably at most 84%, most preferably at most 72% of the nominal power of the lamp.

6. A method according to claim 4, wherein the switch-over from the AC mode of operation to the temporary DC mode of operation comprises abruptly decreasing the lamp power from the AC power lower limit value to a DC lower power value.

7. A method according to claim 6, wherein the DC lower power value comprises at most 84%, more preferably at most 72%, most preferably at most 60% of the lamp nominal power.

8. A method according to claim 1, wherein, at a switch-over from the temporary DC mode of operation to the AC mode of operation, the lamp power is abruptly increased from a lower power value to a return power value.

9. A method according to claim 8, wherein the return power value exceeds the AC power lower limit value by at least 2%, more preferably by at least 4% of the lamp nominal power.

10. A method according to claim 1, wherein the intermediate environment variable threshold value at which the switch-over is made from the temporary DC mode of operation to the AC mode of operation is significantly different from an environment variable threshold value at which the changeover was made from the AC mode of operation to the temporary DC mode of operation.

11. A method according to claim 1, wherein the step of monitoring an environment variable comprises measuring a temperature in the specific region of the lamp.

12. A gas-discharge lamp comprising a burner in which a first electrode and a second electrode are arranged on either side of a discharge gap, which lamp is realised such that the position of a coldest spot during an AC mode of operation is in the vicinity of the first electrode; and which lamp comprises a driver for driving the lamp according to conditions in a specific region (R) of the lamp, which driver is realised to initially drive the lamp in an AC mode of operation;

monitor an environment variable of the lamp, which environment variable is indicative of conditions in the specific region of the lamp;

switch to a temporary DC mode of operation at a DC power value on the basis of the monitored environment variable, and thereby to allocate the first electrode as anode; and to drive the lamp in the DC mode of operation until the monitored environment variable has returned to an intermediate environment variable threshold value.

13. A gas-discharge lamp according to claim 12, comprising a discharge vessel enclosing a discharge chamber sealed by an inner pinch and an outer pinch, wherein the inner pinch is realised to hold the inner electrode and the outer pinch is realised to hold the outer electrode, and wherein the outer pinch is formed such that a length ($d_4$) of the electrode, extending from the outer pinch into the discharge chamber is greater than the length of the electrode extending from the inner pinch into the discharge chamber.

14. A driver for a gas discharge lamp, comprising an environment variable input for obtaining an environment variable value; a memory for storing a plurality of environment variable threshold values; and a comparator for comparing the monitored environment variable value to an environment variable threshold value, which driver is realised to initially drive the lamp in an AC mode of operation;

monitor an environment variable of the lamp, which environment variable is indicative of conditions in a specific region of the lamp;

switch to a temporary DC mode of operation at a DC power value on the basis of the monitored environment variable, and thereby to allocate the first electrode as anode; and to drive the lamp in the DC mode of operation until the monitored environment variable has returned to an intermediate environment variable threshold value.

15. A driver according to claim 14, comprising a memory for storing an anode specification flag, which anode specification flag indicates which electrode of the electrode pair is to be driven as anode during a DC mode of operation.

* * * * *